US005762647A

United States Patent [19]

Brown et al.

[11] Patent Number: 5,762,647

[45] Date of Patent: Jun. 9, 1998

[54] METHOD OF LAUNDERING WITH A LOW SUDSING GRANULAR DETERGENT COMPOSITION CONTAINING OPTIMALLY SELECTED LEVELS OF A FOAM CONTROL AGENT BLEACH ACTIVATOR/PEROXYGEN BLEACHING AGENT SYSTEM AND ENZYME

[75] Inventors: Donald R. Brown, Middletown; Patti J. Kellett, West Chester; Wendell I. Norman, Cincinnati; Richard T. Owen; Ronald A. Swift, both of West Chester, all of Ohio

[73] Assignee: The Procter & Gamble Company, Cincinnati, Ohio

[21] Appl. No.: 703,438

[22] Filed: Sep. 16, 1996

Related U.S. Application Data

[63] Continuation-in-part of Ser. No. 562,080, Nov. 21, 1995, abandoned.

[51] Int. Cl.[6] ..... D06L 1/00

[52] U.S. Cl. ..... 8/137; 510/305; 510/312; 510/315; 510/317; 510/320; 510/361; 510/374; 510/376; 510/392; 510/466; 510/474; 510/491; 510/507

[58] Field of Search ..... 510/305, 312, 510/315, 320, 353, 358, 317, 361, 374, 376, 392, 466, 474, 491, 507; 8/137

[56] References Cited

U.S. PATENT DOCUMENTS

| | | | |
|---|---|---|---|
| H1468 | 8/1995 | Costa et al. | 252/90 |
| 4,412,934 | 11/1983 | Chung et al. | 252/186.38 |
| 4,447,349 | 5/1984 | Tai | 252/174.13 |
| 4,451,387 | 5/1984 | Tai | 252/174.15 |
| 4,652,392 | 3/1987 | Baginski et al. | 252/109 |
| 4,806,266 | 2/1989 | Burrill | 252/174.15 |
| 4,824,593 | 4/1989 | Appel et al. | 252/127 |
| 4,999,128 | 3/1991 | Sonenstein | 510/299 |
| 5,238,596 | 8/1993 | Smith | 252/174.15 |
| 5,248,434 | 9/1993 | Nicholson | 252/95 |
| 5,318,728 | 6/1994 | Surutzidis et al. | 510/323 |
| 5,540,856 | 7/1996 | Wevers et al. | 510/347 |
| 5,595,967 | 1/1997 | Miracle et al. | 510/372 |
| 5,629,278 | 5/1997 | Baeck et al. | 510/236 |

FOREIGN PATENT DOCUMENTS

| | | | |
|---|---|---|---|
| 0 142 910 A2 | 5/1985 | European Pat. Off. | C11D 3/00 |
| 0 206 522 A2 | 12/1986 | European Pat. Off. | C11D 3/00 |
| 0 210 731 A2 | 2/1987 | European Pat. Off. | C11D 3/37 |
| 0 495 345 A1 | 7/1992 | European Pat. Off. | B01D 19/04 |
| 0 636 684 A2 | 2/1995 | European Pat. Off. | C11D 3/12 |
| 0 636 685 A2 | 2/1995 | European Pat. Off. | C11D 3/12 |
| WO 95/02665 | 1/1995 | WIPO . | |
| WO 95/27773 | 10/1995 | WIPO . | |

*Primary Examiner*—Douglas J. McGinty
*Assistant Examiner*—Lorna M. Douyon
*Attorney, Agent, or Firm*—Ken K. Patel; Kim William Zerby; Jacobus C. Rasser

[57] ABSTRACT

A method of laundering soiled fabrics comprises contacting the fabrics in an aqueous laundering solution with a granular detergent composition comprising at least about 1% by weight of a surfactant, at least about 1% by weight of a builder, from about 6% to about 9% by weight of a particulate foam control agent, from about 1% to about 5% by weight of bleach activator, from about 0.3% to about 7% by weight of a peroxygen bleaching agent and from about 0.05% to about 0.2% by weight of a cellulase enzyme, wherein the detergent composition produces the low level of foam required for optimal cleaning in washing machines employing a low water wash process.

9 Claims, No Drawings

METHOD OF LAUNDERING WITH A LOW SUDSING GRANULAR DETERGENT COMPOSITION CONTAINING OPTIMALLY SELECTED LEVELS OF A FOAM CONTROL AGENT BLEACH ACTIVATOR/PEROXYGEN BLEACHING AGENT SYSTEM AND ENZYME

This is a continuation-in-part of application Ser. No. 08/562,080, filed on Nov. 21, 1995 now abandoned.

FIELD OF THE INVENTION

The present invention relates to detergent compositions, and more particularly to granular detergent compositions employed in low water wash processes. The invention is directed to granular detergent compositions containing a low level of a bleach activator, a peroxygen bleaching agent, and a cellulase enzyme, while containing a high level of a selected particulate foam control agent. Together these components produce a reduced level of suds in a low water wash process as well as surprisingly increased stain removal and bleaching effects typically not expected from compositions containing low levels of bleach activator, bleaching agent and enzyme.

1. Background of the Invention

As is well known, detergent compositions, in granular or powder form, have been used in commercially available machines for laundering textiles. These detergent compositions generally contain certain organic surfactants, builders, bleaching agents and various inorganic or organic additives. The conventional method of laundering textiles, used by United States consumers in the home, is carried out by placing from about 5 pounds to about 8 pounds of textiles into a top loading washing machine which typically uses about 45 gallons of water. Detergent is added to the machine in an amount determined by the manufacturer to provide the best cleaning results for a specified amount of textiles and volume of water. The water and detergent form what is referred to as the wash liquor. Soil is removed from the textiles and suspended in the wash liquor by mechanical agitation. At the end of the washing cycle, the wash liquor is drained from the wash basket and the textiles are rinsed with water. Additional mechanical agitation, which occurs during the rinse cycle, removes the detergent residue from the textiles. After the rinse water is drained from the wash basket, a high speed spin of the wash basket removes most of the water from the textiles.

A number of features of the conventional washing method could be improved to provide better consumer satisfaction with the process itself and the results obtained. For example, the changing of one feature, the amount of water used in the wash process, would result in a sizable cost savings to the consumer. It is well-established that the largest single factor effecting the consumer's cost per wash load is the amount of energy used to heat the water used in the washing cycle.

Accordingly, it would be desirable to modify existing washing processes to consume less energy, and therefore result in a lower cost to the consumer. One such convenient way in which this can be accomplished is to reduce the amount of water consumed in the process. In response to this need, washing machines have been developed which use less water in the wash process and represent a significant improvement over existing technology since the cost to the consumer of each load of clothes cleaned is tremendously decreased. Appliance or washing machine manufacturers responding to this need for a washing machine have developed so-called "low water" washing machines which use about 25 gallons of water for each wash and rinse cycle or 40% less water than conventional top loading washing machines. For maximum cleaning benefits, the detergent used in such low water washing processes must be tailored to the machine operating conditions. Currently available detergent compositions are not optimized to deliver superior cleaning results in newly developed low water wash systems. During the mechanical agitation phase of a normal wash cycle, surfactants in the detergent composition can produce an excessive amount of foam, which reduces the quality of the washing process. Where a reduced amount of water is used in the washing process, currently available detergent compositions almost always produce unacceptably large amounts of foam which are found aesthetically objectionable to consumers and which reduce the level of cleaning resulting from the washing process.

Thus, the need exists for a commercially available detergent composition capable of producing superior cleaning over current detergent formulations, especially when used at a high concentration in a low water wash process. While the detergency art is replete with references which teach detergent compositions which include at least a minor amount of a particulate foam control agent to control the amount of foam produced during conventional wash cycles, the art falls short of suggesting a detergent composition which provides effective sudsing control in "low water" washing machines while also maintaining superior cleaning performance. This need is especially prevalent when the low water washing process involves washing liquors having low temperatures, i.e. less than about 30° C.

Accordingly, despite the aforementioned disclosures in the art, there remains a need in the art for a granular detergent composition which effectively controls sudsing, especially in low wash water washing machines, and yet maintains superior cleaning performance. There is also a need for such a detergent composition which exhibits superior sudsing control and cleaning performance in a low water washing machine that uses cold water (less than about 30° C.).

2. Background Art

The following patents disclose detergent compositions comprising a particulate foam control agent: Smith, U.S. Pat. No. 5,238,596 (Dow Corning, S. A.); Burrill, U.S. Pat. No. 4,806,266 (Dow Corning Ltd.); Appel et al, U.S. Pat. No. 4,824,593 (Lever Brothers Company); Baginski et al, U.S. Pat. No. 4,652,392 (The Procter & Gamble Company); Tai, U.S. Pat. No. 4,447,349 (Lever Brothers Company); Tai, U.S. Pat. No. 4,451,387 (Lever Brothers Company); Burrill, EP 0210731 (Dow Corning Limited); Foret, EP0206522 (Unilever PLC); Gowland, EP 0142910 (Procter & Gamble Limited); De Cupere, EP0495345A1 (The Procter & Gamble Company); Kolaltis, EP0636684A2 (Dow Corning S.A.); Kolaltis, EP0636685A2 (Dow Corning S. A.).

The following patents disclose bleaching compositions: Chung et al, U.S. Pat. No. 4,412,934 (The Procter & Gamble Company); Nicholson, U.S. Pat. No. 5,248,434 (The Procter & Gamble Company).

SUMMARY OF THE INVENTION

The aforementioned needs in the art are met by the present invention which provides granular detergent composition which is not sudsy in a low water wash process and which provides superior stain removal and bleaching effects. The detergent composition comprises high levels of a particulate foam control agent in combination with optimally selected levels of a surfactant, builder, a peroxygen bleaching agent and activator therefor, and cellulase enzyme. Preferably, the granular detergent composition is substantially free of phosphates. The detergent composition unexpectedly produces low levels of foam required for optimal cleaning in a low water wash process which employs a reduced amount of wash water as compared to currently available methods. Also, unexpected superior cleaning performance, and enhanced brightening of the colors of dyed fabrics, is exhibited despite the use of low levels of key ingredients such as bleaches, bleaching agents and enzymes.

As used herein, the phrase "low water wash process" refers to a washing process where the total amount of wash and rinse water employed in all cycles of a commercially available washing machine is no more than 30 gallons, preferably less than 25 gallons or the concentration of the detergent is from about 2,000 parts per million (ppm) to about 10,000 ppm. In addition, the low water wash process is further characterized by a fabric to water ratio of from 1:1 to 1:9, a water volume of from about 3 to about 8 gallons, and a wash time of from about 8 to about 16 minutes.

All percentages, ratios and proportions used herein are by weight, unless otherwise specified. All documents including patents and publications cited herein are incorporated herein by reference.

In accordance with one aspect of the invention, a detergent composition in the form of granules is provided herein. The detergent composition comprises at least about 1% by weight of a surfactant and at least about 1% by weight of a builder. The detergent composition also includes from about 6% to about 9% of a particulate foam control agent. In addition, the detergent composition includes from about 1% to about 5% of a bleach activator, from about 0.3% to about 7% of a peroxygen bleaching agent and from about 0.05% to about 0.2% of a cellulase enzyme. The bleach activator and the peroxygen bleaching agent are present in the detergent composition in a weight ratio of from about 0.5:1 to about 4:1 in the granular detergent composition. The detergent composition produces the low level of foam required for optimal cleaning in washing machines employing a low water wash process.

In another embodiment of the invention, yet another granular detergent composition is provided. This detergent composition comprises from about 1% to about 50% by weight of a surfactant; from about 1% to about 75% by weight of a builder; from about 6% to about 9% by weight of a particulate foam control agent which contains a silicone antifoam compound, an organic material and a carrier material onto which the silicone antifoam agent and the organic material are deposited. The organic material is selected from at least one fatty acid having a carbon chain containing from 12 to 20 carbon atoms, the organic material having a melting point in the range of 45° to 80° C. and being insoluble in water; at least one fatty alcohol having a carbon chain containing from 12 to 20 carbon atoms, the organic material having a melting point in the range of 45° to 80° C. and being insoluble in water; a mixture of at least one fatty acid and one fatty alcohol, each having a carbon chain containing from 12 to 20 carbon atoms, the organic material having a melting point in the range of 45° to 80° C. and being insoluble in water; an organic material having a melting point in the range of 50° to 85° C. and comprising a monoester of glycerol and a fatty acid having a carbon chain containing from 12 to 20 carbon atoms; a dispersing polymer; and mixtures of the above described organic materials. The carrier material is selected from native starches and zeolite. In addition, the detergent composition contains from about 1% to about 3% by weight of nonanoyloxybenzene sulfonate and from about 0.5% to about 6% by weight of a peroxygen bleaching agent selected from the group consisting of percarbonates, perborates, peroxides and mixtures thereof. In addition, the detergent composition contains from about 0.1% to about 0.2% by weight of a cellulase enzyme. The nonanoyloxybenzene sulfonate and peroxygen bleaching agent are present in the detergent composition in a weight ratio of from about 1:1 to about 3:1 in the detergent composition.

In a preferred embodiment, the detergent composition comprises from about 10% to about 35% by weight of an anionic surfactant selected from the group consisting of alkyl ethoxylated sulfate, alkyl sulfate and linear alkyl benzene sulfonate and mixtures thereof. The composition also includes from about 20% to about 60% by weight of a builder selected from the group consisting of citric acid, aluminosilicates, carbonates, phosphates and mixtures thereof, and from about 6% to about 9% by weight of a particulate foam control agent which contains a silicone antifoam compound, an organic material and a carrier material onto which the silicone antifoam agent and the organic material are deposited. The organic material is selected from at least one fatty acid having a carbon chain containing from 12 to 20 carbon atoms, the organic material having a melting point in the range of 45° to 80° C. and being insoluble in water; at least one fatty alcohol having a carbon chain containing from 12 to 20 carbon atoms, the organic material having a melting point in the range of 45° to 80° C. and being insoluble in water; a mixture of at least one fatty acid and one fatty alcohol, each having a carbon chain containing from 12 to 20 carbon atoms, the organic material having a melting point in the range of 45° to 80° C. and being insoluble in water; an organic material having a 30 melting point in the range of 50° to 85° C. and comprising a monoester of glycerol and a fatty acid having a carbon chain containing from 12 to 20 carbon atoms; a dispersing polymer; and mixtures of the above described organic materials. The carrier material is selected from native starches and zeolite. The detergent composition also contains from about 1% to about 3% by weight of nonanoyloxybenzene sulfonate, from about 0.5% to about 6% by weight of a peroxyen bleaching agent selected from the group consisting of percarbonates, perborates, peroxides and mixtures thereof. The detergent composition also contains from about 0.1% to about 0.2% by weight of a cellulase enzyme. In this preferred embodiment, nonanoyloxybenzene sulfonate and peroxygen bleaching agent are present in the detergent composition in a weight ratio of from about 1:1 to about 2:1.

Yet another embodiment of the detergent composition comprises at least about 1% by weight of a surfactant and at least about 1% by weight of a builder. From about 6% to about 9% by weight of a particulate foam control agent which contains a silicone antifoam compound, an organic material and a carrier material onto which the silicone antifoam agent and the organic material are deposited, is also included in the composition. The organic material is selected from at least one fatty acid having a carbon chain containing from 12 to 20 carbon atoms, the organic material having a melting point in the range of 45° to 80° C. and being insoluble in water; at least one fatty alcohol having a carbon chain containing from 12 to 20 carbon atoms, the organic material having a melting point in the range of 45° to 80° C. and being insoluble in water; a mixture of at least one fatty acid and one fatty alcohol, each having a carbon chain containing from 12 to 20 carbon atoms, the organic material having a melting point in the range of 45° to 80° C.

and being insoluble in water; an organic material having a melting point in the range of 50° to 85° C. and comprising a monoester of glycerol and a fatty acid having a carbon chain containing from 12 to 20 carbon atoms; a dispersing polymer; and mixtures of the above described organic materials. The carrier material is selected from native starches and zeolite. In addition, from about 1% to about 5% by weight of a bleach activator; and from about 0.3% to about 7% by weight of a peroxygen bleaching agent, whereby the bleach activator and peroxygen bleaching agent are in a weight ratio of about 0.5:1 to about 4:1, is included in the composition. In this embodiment the cellulase enzyme is absent, yet the detergent composition exhibits superior stain removal, bleaching effects and the enhancement and brightening of the colors of dyed fabrics.

In accordance with other aspects of the invention, methods of laundering soiled fabrics are also provided. The method comprises the step of contacting soiled fabrics with an effective amount of a detergent composition as described herein in an aqueous laundering solution wherein the weight ratio of soiled fabrics to water is from about 1:1 to about 1:9. Another method of laundering soiled fabrics comprises the step of contacting fabrics with a detergent composition as described herein in an aqueous laundering solution wherein from about 2,000 ppm to about 10,000 ppm of the detergent composition is present in the aqueous laundering solution.

Accordingly, it is an object of the present invention to provide a granular detergent composition which is capable of producing superior cleaning over current detergent formulations, and which can be used at a high concentration in a low water wash process without producing excessive amounts of foam. It is also an object of the invention to provide such a detergent composition which exhibits superior stain removal, bleaching effects, and which enhances and brightens the colors of dyed fabrics, even in cold temperature low water washing solutions. These and other objects, features and attendant advantages of the present invention will become apparent to those skilled in the art from reading of the following detailed description of the preferred embodiment and the appended claims.

DETAILED DESCRIPTION OF THE PREFERRED EMBODIMENT

The invention is directed to a granular detergent composition which does not produce excessive foam in a low water wash process and which exhibits superior stain removal and bleaching effects in cold temperature water (less than about 30° C.). Commercially available laundry detergents are formulated to provide the consumer with effective cleaning when used in conventional washing machine appliances. For example, most known laundry detergent formulations contain agents to suppress suds and are designed so that only a small amount of foam is produced during the washing process. The amount of foam produced is effected by the style and strength of mechanical agitation employed in the washing process, as well as by the amount of water used and the concentration of the detergent added to the washing machine.

When the volume of water used in the wash and rinse cycles is reduced below the customary 45 gallons, but the dose of detergent, in the wash cycle, is not concomitantly reduced, most detergents will produce excessive foam with a resultant decrease in the efficacy of the detergent. The addition of suds suppression agents to laundry detergents combats this problem. It has been found that a granular detergent composition which comprises high levels of a particulate foam control agent in combination with optimally selected levels of a surfactant, builder, a bleach activator/bleaching agent system and cellulase enzyme, produces reduced amounts of foam in low water wash processes and unexpectedly superior cleaning stain removal. It has also been found that addition of copolymers of N-vinylpyrrolidone and N-vinylimidazole ("PVPVI") and polyamine N-oxide ("PVNO") to the described low suds low wash water detergent composition results in superior prevention of fabric-to-fabric dye transfers in the low wash water process while still maintaining excellent cleansing properties.

Preferably the granular composition comprises at least about 1% and preferably from about 1% to about 50% by weight of a surfactant. Most preferably, the granular detergent composition comprises from about 10% to about 35% by weight of an anionic surfactant selected from the group consisting of alkyl ethoxylated sulfates, alkyl sulfates and linear alkyl benzene sulfonates and mixtures thereof. Preferably, the granular composition of the invention also comprises at least about 1%, preferably from about 1% to about 75%, and most preferably from about 20% to about 60% by weight of a detergency builder.

For the purpose of controlling the formation of foam in the washing process, the granular detergent composition comprises from about 2% to about 10% by weight of a particulate foam control agent, preferably from about 5% to about 9% by weight, and most preferably, from about 6% to about 9% of a particulate foam control agent, which contains a silicone antifoam compound, an organic material and a carrier material onto which the silicone antifoam agent and the organic material are deposited. To remove stains and soils, and provide surface bleaching, the granular detergent composition contains a bleach activator/bleaching agent system which comprises from about 1% to about 5% of a bleach activator and from about 0.3% to about 7% by weight of a peroxygen bleaching agent whereby the bleach activator and peroxygen bleaching agent are in a weight ratio of about 0.5:1 to about 4:1 in the granular detergent composition. Preferably, the granular detergent composition comprises from about 1% to about 3% by weight of nonanoyloxybenzene sulfonate and from about 0.5% to about 6% by weight of a peroxygen bleaching agent selected from the group consisting of percarbonates, perborates, peroxides and mixtures thereof, whereby the nonanoyloxybenzene sulfonate and peroxygen bleaching agent are preferably in a weight ratio of about 1:1 to about 3:1, and most preferably in a weight ratio of 1:1 to about 2:1, in the detergent composition. To enhance and brighten the colors of dyed fabrics, such granular detergent compositions comprise from about 0.05% to about 0.2%, and preferably from about 0.1% to about 0.2% by weight, of a cellulase enzyme. In another preferred embodiment of the invention, the detergent composition contains selected levels of dye transfer inhibitors. Preferably, the dye transfer inhibitors are selected from PVNO, PVPVI, and mixtures thereof. The granular detergent composition may also include one or more of adjunct detergent ingredients. Nonlimiting examples of the detergency surfactant, detergency builder, foam control agent, bleach activator/bleaching agent system, cellulase enzyme, dye transfer inhibitors, and adjunct ingredients are described in detail hereinafter.

Surfactant

As mentioned, the compositions of the invention include a surfactant. Preferably, the surfactant is from the group consisting of nonionic, anionic, cationic, zwitterionic and amphoteric surfactants and mixtures thereof. Nonlimiting examples of surfactants useful herein typically include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $C_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters.

If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. A typical nonionic surfactant that may be used in the present invention is NEODOL™ 23-9, an ethoxylate of fatty alcohol commercially available from Shell Chemical Co.. The level of NEODOL™ 23-9 in the detergent composition is preferably from about 0.1% to about 5%. Other conventional useful surfactants are listed in standard texts.

Builder

Detergent builders are included in the compositions herein to assist in controlling mineral hardness. Inorganic as well as organic builders can be used. Builders are typically used in fabric laundering compositions to assist in the removal of particulate soils.

The level of builder in the granular detergent composition is at least about 1% by weight, is preferably from about 1% to about 75% by weight, and is most preferably from about 20% to about 60% by weight. Lower or higher levels of builder, however, are not meant to be excluded. Said builder is preferably selected from the group consisting of citric acid, aluminosilicates, carbonates, phosphates and mixtures thereof.

Inorganic or phosphate-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulfates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}$. $yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention.

Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolyearboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosplhonate and other known phosphonates (see, for example, U.S. Pat. Nos. 3,159,581; 3,213,030; 3,422,021, 3,400,148 and 3,422,137) can also be used.

Suitable additional detergency builders for use herein are enumerated in the Baskerville patent, Column 13,line 54 through Column 16, line 16, and in U.S. Pat. No. 4,663,071, Bush et al, issued May 5, 1987, both incorporated herein by reference.

Foam Control Agent

Compounds for reducing or suppressing the formation of suds are essential to the compositions of the present invention. Suppression of suds is of particular importance in the so-called "high concentration cleaning process" as described in U.S. Pat. Nos. 4,489,455 and 4,489,574, in the "low water wash process" as it is described in this invention, and in front-loading European-style washing machines. For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of preferred suds suppressors is the non-surfactant silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica.

The preferred particulate foam control agent used herein, contains a silicone antifoam compound, an organic material and a carrier material onto which the silicone antifoam compound and the organic material are deposited. The carrier material is preferably a native starch or zeolite. The silicone antifoam compound is selected from the group consisting of polydiorganosiloxane, solid silica and mixtures thereof. Preferably, the organic material is selected from:

(a) at least one fatty acid having a carbon chain containing from 12 to 20 carbon atoms, said organic material having a melting point in the range 45° C. to 80° C. and being insoluble in water;

(b) at least one fatty alcohol, having a carbon chain containing from 12 to 20 carbon atoms, said organic material having a melting point in the range 45° C. to 80° C. and being insoluble in water;

(c) a mixture of at least one fatty acid and one fatty alcohol, each having a carbon chain containing from 12 to 20 carbon atoms, said organic material having a melting point in the range 45° C. to 80° C. and being insoluble in water;

(d) an organic material having a melting point in the range 50° C. to 85° C. and comprising a monoester of glycerol and a fatty acid having a carbon chain containing from 12 to 20 carbon atoms;

(e) a dispersing polymer; and mixtures thereof.

Preferably, the dispersing polymer is selected from the group consisting of copolymers of acrylic acid and maleic acid, polyacrylates and mixtures thereof.

Typical granular detergent compositions with controlled suds, and consistent with the invention, will optionally comprise from about 2 to about 10%, preferably from about 5 to about 9%, most preferably from about 6 to about 9% by weight, of said particulate foam control agent.

Silicone suds suppressors known in the art which can be used are, for example, disclosed in U.S. Pat. No. 4,265,779, issued May 5, 1981 to Gandolfo et al and European Patent Application No. 89307851.9, published Feb. 7, 1990, by Starch, M. S. Silicone defoamers and suds controlling agents in granular detergent compositions are disclosed in U.S. Pat.

No. 3,933,672, Bartolotta et al, and in U.S. Pat. No. 4,652,392, Baginski et al, issued Mar. 24, 1987.

An exemplary silicone based suds suppressor for use herein is a suds suppressing amount of a particulate foam control agent consisting essentially of:

(a) polydimethylsiloxane fluid having a viscosity of from about 20 cs. to about 1,500 Cs. at 25° C.;

(b) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units of from about 0.6:1 to about 1.2:1; and (c) from about 1 to about 20 parts per 100 parts by weight of (i) of a solid silica gel.

Additional secondary suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_6$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

Another secondary category of suds suppressor of interest encompasses monocarboxylic fatty acid and soluble salts therein. See U.S. Pat. No. 2,954,347, issued Sept. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain other secondary non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexaalkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about –40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

When utilized as suds suppressors, monocarboxylic fatty acids, and salts therein, will be present typically in amounts up to about 5%, by weight, of the detergent composition. Preferably, from about 0.5% to about 3%, by weight, of fatty monocarboxylate suds suppressor is utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5%, by weight of the detergent composition, although higher levels can be used. The alcohol suds suppressors are typically used in amounts ranging from about 0.2% to about 3%, by weight, of the finished compositions.

Bleach Activator/Peroxyen Bleaching Agent System

The detergent compositions herein must contain bleaching systems containing a peroxygen bleaching agent and one or more bleach activators. Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. The bleaching agents will preferably be at levels of from about 0.3% to about 7%, more preferably from about 0.5% to about 6%, of the detergent composition, especially for fabric laundering. The amount of bleach activators will preferably be from about 1% to about 5%, more preferably from about 1% to about 3% of the bleaching composition comprising the bleaching agent-plus-bleach activator.

The bleaching agents selected for use herein can be any of the peroxygen bleaching agents useful for detergent compositions in textile cleaning, hard surface cleaning, or other cleaning purposes that are now known or become known. Peroxygen bleaching agents are preferred and can be selected from the group consisting of percarbonates, perborates, peroxides and mixtures thereof. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. The preferred bleach activator is nonanoyloxybenzene sulfonate (NOBS). Various nonlimiting examples of activators are disclosed in U.S. Pat. No. 4,915,854, issued Apr. 10, 1990 to Mao et al, and U.S. Pat. No. 4,412,934. In these examples, nonanoyloxybenzene sulfonate and tetraacetyl ethylene diamine (TAED) activators are typical, and mixtures thereof can also be used. See also U.S. Pat. No. 4,634,551 for other typical bleaches and activators useful herein.

Suitable secondary amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenestulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of secondarily preferred bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

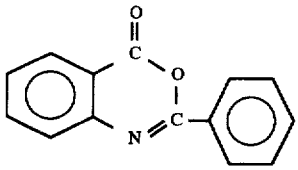

Still another class of preferred bleach activators includes the acyl lactam activators, especially acyl caprolactams and acyl valerolactams of the formulae:

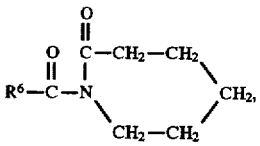

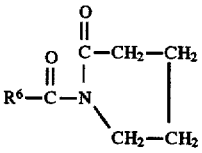

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985,incorporated herein by reference, which discloses acyl caprolactams, including benzoyl caprolactam, adsorbed into sodium perborate.

Bleaching agents other than oxygen bleaching agents are also known in the art and can be utilized herein as secondary bleaching agents. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; and European Pat. App. Pub. Nos. 549,271A1, 549,272A1, 544,440A2, and 544,490A1; Preferred examples of these catalysts include $Mn^{IV}_2(u\text{-}O)_3$(1 4,7-trimethyl-1,4,7-triazacyclononane)$_2(PF_6)_2$, $Mn^{III}_2(u\text{-}O)_1$ $(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. Nos. 4,430,243 5,114,611. The use of manganese with various complex ligands to enhance bleaching is also reported in the following United States Patents: U.S. Pat. Nos. 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Enzyme

Enzymes are typically included in the present detergent compositions for a variety of purposes, including removal of protein-based, carbohydrate-based, or triglyceride-based stains from surfaces such as textiles or dishes, for the prevention of refugee dye transfer, for example in laundering, and for fabric restoration. In the present invention, a cellulase enzyme must be included. Suitable enzymes include cellulases of animal, bacterial and fungal origin. Preferred selections are influenced by factors such as pH-activity and/or stability optima, thermostability, and stability to active detergents, builders and the like.

The cellulase enzymes used in the instant detergent composition preferably comprise from about 0.05% to about 0.2%, and most preferably from about 0.1% to about 0.2%, by weight of a commercial enzyme preparation. The cellulase enzymes suitable for the present invention include both bacterial or fungal cellulase. Preferably, the cellulase enzyme is a fungal cellulase. Optimally, cellulases will have a pH of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeronmonas, and cellulase extracted from the hepatopancreas of a marine mollusk, Dolabella Autricula Solcnder. Suitable cellulases are also disclosed in GB-A-2,075,028; GB-A-2,095,275 and DE-OS-2,247,832. In addition, cellulase enzymes especially suitable for use herein are disclosed in WO 92-13057 (The Procter & Gamble Company). Most preferably, the cellulases used in the instant detergent compositions are purchased commercially from NOVO Industries A/S under the product names CAREZYME® and CELLUZYME®.

Additional secondarily preferred enzymes include proteases, amylases and lipases. Suitable examples of proteases are the subtilisins which are obtained from particular strains of *Bacillus subtilis* and *Bacillus licheniforms*. Another suitable protease is obtained from a strain of Bacillus, having maximum activity throughout the pH range of 8–12, developed and sold by Novo Industries A/S under the registered trade name ESPEPASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Ser. No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

Suitable lipase enzymes for detergent usage include those produced by microorganisms of the Pseudomons group, such as *Pseudomonas stultzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases from *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases from *Pseudomonas gladioli*. The LIPOLASE enzyme derived from *Humicolo lanuginosa* and commercially available from Novo (see also EPO 341,947) is a preferred lipase for use herein.

Dye Transfer Inhibiting Agents

The compositions of the present invention may also include one or more materials effective for inhibiting the transfer of dyes from one fabric to another during the cleaning process. As stated previously, the preferred dye transfer inhibitors include copolymers of N-vinylpyrrolidone and N-vinylimidazole, polyamine N-oxide polymers, and mixtures thereof. Also useful in the composition are polyvinyl pyrrolidone polymers, manganese phthalocyanine, peroxidases, and mixtures thereof. If the dye transfer inhibiting agents are a mixture of copolymers of N-vinylpyrrolidone and N-vinylimidazole ("PVPVI") and polyamine N-oxide polymers ("PVNO"), each typically comprises from about 0.05 to about 0.25%, more preferably about 0.18%, of the detergent composition.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

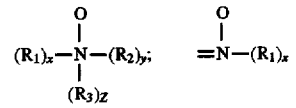

wherein $R_1$, $R_2$, $R_3$ are aliphatic, aromatic, heterocyclic or alicyclic groups or combinations thereof, x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 10,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

Adjunct Ingredients

The compositions herein can optionally include one or more other detergent adjunct materials or other materials for assisting or enhancing cleaning performance, treatment of the substrate to be cleaned, or to modify the aesthetics of the detergent composition (e.g., colorants, dyes, perfumes, etc.). Adjunct ingredients include antitarnish and anticorrosion agents, soil suspending agents, soil release agents, germicides, pH adjusting agents, non-builder alkalinity sources, chelating agents, smectite clays, enzyme-stabilizing agents and perfumes. See U.S. Pat. No. 3,936,537, issued Feb. 3, 1976 to Baskerville, Jr. et al., incorporated herein by reference. Also, fabric conditioning agents may be included as an adjunct material such as those described in U.S. Pat. No. 4,861,502, issued Aug. 29, 1989 to Caswell, incorporated herein by reference.

Chelating agents are also described in U.S. Pat. No. 4,663,071, Bush et al., from Column 17, line 54 through Column 18, line 68, incorporated herein by reference. Suitable smectite clays for use herein are described in U.S. Pat. No. 4,762,645, Tucker et al, issued August 9, 1988, Column 6,line 3 through Column 7, line 24, incorporated herein by reference.

Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Process

The compositions herein are typically comprised of spray-dried base granules and admixed and sprayed-on ingredients. The base granules are prepared by a conventional spray drying process in which the starting ingredients are formed into a slurry and passed though a spray drying tower having a countercurrent stream of hot air (200°–300° C.) resulting in the formation of porous granules. These base granules can be subjected to additional processing steps such as grinding and the like so as to provide a composition having a density of at least about 650 g/l:

Optionally, a portion of the detergent ingredients can be in the form of agglomerates and admixed. By way of example, the agglomerates are formed from two feed streams of various starting detergent ingredients which are continuously fed, at a rate of 1400 kg/hr, into a Lödige CB-30 mixer/densifier, one of which comprises a surfactant paste containing surfactant and water and the other stream containing starting dry detergent material containing aluminosilicate and sodium carbonate. The rotational speed of the shaft in the Lödige CB-30 mixer/densifier is about 1400 rpm and the median residence time is about 5–10 seconds. The contents from the Lödige CB-30 mixer/densifier are continuously fed into a Lödige KM-600 mixer/densifier for further agglomeration during which the mean residence time is about 6 minutes. The resulting detergent agglomerates are then fed to a fluid bed dryer and to a fluid bed cooler before being admixed with the spray dried granules. The remaining adjunct detergent ingredients are sprayed on or dry added to the blend of agglomerates and granules, typically in an granule to agglomerate weight ratio of 5:1 to about 1:1, preferably of about 3:2.

In order to make the present invention more readily understood, reference is made to the following examples, which are intended to be illustrative only and not intended to be limiting in scope.

EXAMPLES I–IV

Several granular detergent compositions made in accordance with the invention and specifically suitable for low water wash processes are exemplified below. The base granule is prepared by a conventional spray drying process in which the starting ingredients are formed into a slurry and passed though a spray drying tower having a countercurrent stream of hot air (200°–300° C.) resulting in the formation of porous granules. The remaining adjunct detergent ingredients are sprayed on or dry added to the granules.

| | Examples (% Weight) | | | | |
|---|---|---|---|---|---|
| Component | I | II | III | IV | V |
| $C_{12-13}$ linear alkyl benzene sulfonate | 7.5 | 7.5 | 7.5 | 7.5 | 7.4 |
| $C_{14-15}$ alkyl sulfate | 7.2 | 7.2 | 7.2 | 7.2 | 7.0 |
| $C_{14-15}$ alkyl ethoxylate sulfate (EO = 1.2) | 2.8 | 2.8 | 2.8 | 2.8 | 2.8 |
| Polyethylene glycol (MW = 4000) | 2.0 | 2.0 | 2.0 | 2.0 | 1.9 |
| Polyacrylate (MW = 4500) | 4.3 | 4.3 | 4.3 | 4.3 | 4.3 |
| Sodium silicate | 1.0 | 1.0 | 1.0 | 1.0 | 1.0 |
| Aluminosilicate | 23.7 | 23.7 | 23.7 | 23.7 | 24.5 |
| Sodium carbonate | 21.0 | 21.0 | 21.0 | 21.0 | 20.6 |
| Sodium sulfate | 9.6 | 9.6 | 9.6 | 9.6 | 9.4 |
| Nonanoyloxybenzene sulfonate | 2.6 | 5.5 | 1.5 | 2.6 | 2.6 |
| Perborate | 1.4 | 3.3 | 0.7 | 1.4 | 1.4 |
| Protease enzyme | 0.3 | 0.3 | 0.3 | 0.3 | 0.3 |
| Cellulase enzyme | 0.1 | 0.1 | 0.1 | 0.1 | 0.1 |
| Polydimethylsiloxane I* | 6.4 | 6.4 | 6.4 | 0.0 | 0.0 |
| Polydimethylsiloxane II** | 0.0 | 0.0 | 0.0 | 6.4 | 6.4 |
| Diethylenetriamine pentaacetic acid | 0.5 | 0.5 | 0.5 | 0.5 | 0.5 |
| Copolymer of N-vinylpryyolidone and N-vinylimidazole (MW = 10,000) | 0.0 | 0.0 | 0.0 | 0.0 | 0.2 |
| Polyamine N-oxide (MW = 10,000) | 0.0 | 0.0 | 0.0 | 0.0 | 0.2 |
| Nonionic surfactant (Neodol ™ 23-9) | 0.0 | 0.0 | 0.0 | 0.0 | 0.5 |
| Minors (water, perfume, brightener, etc.) | 9.6 | 4.8 | 11.4 | 9.6 | 8.9 |
| | 100.0 | 100.0 | 100.0 | 100.0 | 100.0 |

*carrier = starch;
**carrier and organic material = zeolite and dispersing polymer

Having thus described the invention in detail, it will be clear to those skilled in the art that various changes may be made without departing from the scope of the invention and the invention is not to be considered limited to what is described in the specification. The present invention meets the aforementioned needs in the art by providing a granular detergent composition which is not sudsy in a low water wash process and which provides superior stain removal and bleaching effects.

What is claimed is:

1. A method of laundering soiled fabrics comprising the steps of contacting said fabrics in an aqueous laundering solution with a granular detergent composition containing:

(a) from about 1% to about 50% by weight of a surfactant;

(b) from about 1% to about 75% by weight of a builder;

(c) from 6% to about 9% by weight of a particulate foam control agent;

(d) from about 1% to about 5% by weight of a bleach activator;

(e) from about 0.3% to about 7% by weight of a peroxygen bleaching agent; and (f) from about 0.05% to about 0.2% by weight of a cellulase enzyme;

whereby the bleach activator and peroxygen bleaching agent are in a weight ratio of about 05:1 to about 4:1 in the granular detergent composition, said detergent composition being used at a concentration amount in said aqueous solution of from 2000 ppm to about 10,000 ppm, wherein the water volume is from about 3 gallons to 8 gallons at a temperature of less than about 30° C., said fabric to water weight ratio is from about 1:1 to about 1:9 and said fabrics undergo a wash time of from about 8 minutes to about 16 minutes.

2. A method according to claim 1 wherein said surfactant is selected from the group consisting of nonionic, anionic, cationic, zwitterionic and amphoteric surfactants and mixtures thereof.

3. A method according to claim 1 wherein said builder is selected from the group consisting of citric acid, aluminosilicates, carbonates, phosphates and mixtures thereof.

4. A method according to claim 1 wherein said particulate foam control agent contains:

(a) a silicone antifoam compound;

(b) an organic material selected from the group consisting of:

(i) at least one fatty acid having a carbon chain containing from 12 to 20 carbon atoms, said organic material having a melting point in the range of 45° to 80° C. and being insoluble in water, (ii) at least one fatty alcohol having a carbon chain containing from 12 to 20 carbon atoms, said organic material having a melting point in the range of 45° to 80° C. and being insoluble in water, (iii) a mixture of at least one fatty acid and one fatty alcohol, each having a carbon chain containing from 12 to 20 carbon atoms, said organic material having a melting point in the range of 45° to 80° C. and being insoluble in water, (iv) an organic material having a melting point in the range of 50° to 85° C. and comprising a monoester of glycerol and a fatty acid having a carbon chain containing from 12 to 20 carbon atoms, (v) a dispersing polymer, and (vi) mixtures of the organic materials in parts (i) through (v); and (c) a carrier material selected from the group consisting of native starches and zeolite onto which the silicone antifoam compound and the organic material are deposited.

5. A method according to claim 4 wherein said silicone antifoam compound is selected from the group consisting of polydiorganosiloxane, solid silica and mixtures thereof.

6. A method according to claim 4 wherein said dispersing polymer is selected from the group consisting of copolymers of acrylic acid and maleic acid, polyacrylates and mixtures thereof.

7. A method according to claim 1 wherein said bleach activator is nonanoyloxybenzene sulfonate.

8. A method according to claim 1 wherein said peroxygen bleaching agent is selected from the group consisting of percarbonates, perborates, peroxides and mixtures thereof.

9. A method according to claim 1 wherein said cellulase enzyme is a fungal cellulase.

* * * * *